US009364889B2

(12) United States Patent
Chaudhry et al.

(10) Patent No.: US 9,364,889 B2
(45) Date of Patent: Jun. 14, 2016

(54) FOAM PATTERN TECHNIQUES

(71) Applicant: FOPAT LLC, Miamisburg, OH (US)

(72) Inventors: Anil R. Chaudhry, Xenia, OH (US); Robert Dzugan, Cincinnati, OH (US); Richard M. Harrington, Cincinnati, OH (US); Faurice D. Neece, Lyndhurst, OH (US); Nipendra P. Singh, Pepper Pike, OH (US); Travis Westendorf, Centerville, OH (US)

(73) Assignee: IC PATTERNS, LLC, Miamisburg, OH (US)

( * ) Notice: Subject to any disclaimer, the term of this patent is extended or adjusted under 35 U.S.C. 154(b) by 169 days.

(21) Appl. No.: 13/734,358

(22) Filed: Jan. 4, 2013

(65) Prior Publication Data

US 2013/0174996 A1 Jul. 11, 2013

Related U.S. Application Data

(60) Provisional application No. 61/583,221, filed on Jan. 5, 2012.

(51) Int. Cl.
*B22C 7/02* (2006.01)
*B22C 9/04* (2006.01)

(52) U.S. Cl.
CPC .. *B22C 7/023* (2013.01); *B22C 9/04* (2013.01)

(58) Field of Classification Search
CPC ..... B22C 7/005; B22C 7/02; B22C 7/023; B22C 7/026
See application file for complete search history.

(56) References Cited

U.S. PATENT DOCUMENTS

| | | | | | |
|---|---|---|---|---|---|
| 2,752,653 | A | * | 7/1956 | Emblem et al. | 164/45 |
| 3,320,345 | A | * | 5/1967 | Lirones | 264/255 |
| 3,747,663 | A | | 7/1973 | Taylor | |
| 4,240,492 | A | | 12/1980 | Edwards et al. | |
| 4,274,823 | A | * | 6/1981 | Stanciu et al. | 425/145 |
| 4,397,247 | A | | 8/1983 | Lemelson | |
| 4,641,702 | A | * | 2/1987 | Petrenchik | B22C 7/02 164/137 |
| 4,650,626 | A | | 3/1987 | Kurokawa | |
| 4,660,623 | A | | 4/1987 | Ashton | |
| 4,877,078 | A | | 10/1989 | Wittmoser | |
| 4,982,781 | A | | 1/1991 | Carpenter et al. | |
| 4,987,944 | A | * | 1/1991 | Parks | 164/10 |
| 5,002,475 | A | | 3/1991 | Graefe | |
| 5,247,984 | A | * | 9/1993 | Stanciu | 164/35 |

(Continued)

FOREIGN PATENT DOCUMENTS

JP 62083112 A 4/1987

*Primary Examiner* — Kevin P Kerns
*Assistant Examiner* — Jacky Yuen
(74) *Attorney, Agent, or Firm* — Thomas E. Lees, LLC

(57) ABSTRACT

Various techniques are provided for creating fugitive foam patterns for use in investment casting operations. In certain illustrative embodiments, a fugitive foam pattern is assembled from independently formed portions. A first section is formed in a mold. Once cured, a mating surface of the first section is exposed to the cavity of a second mold and the section is formed. The second section integrally adheres to the first section. The process is repeated as necessary. In alternative embodiments, a channel is created in a foam pattern using a temporary core that is removed without chemical leaching. The core material comprises water-soluble materials, acid-soluble materials, low-melting point materials, or a combination thereof. A pattern may also be created by inserting foam around a core that remains with the foam pattern.

15 Claims, 15 Drawing Sheets

(56) References Cited

U.S. PATENT DOCUMENTS

| | | | | |
|---|---|---|---|---|
| 5,332,022 | A | 7/1994 | Colvin | |
| 5,676,900 | A | 10/1997 | Pajtas | |
| 5,735,336 | A | 4/1998 | Oti | |
| 6,344,160 | B1 | 2/2002 | Holtzberg | |
| 6,481,490 | B1 | 11/2002 | Vihtelic et al. | |
| 6,901,989 | B1 | 6/2005 | Sargent et al. | |
| 7,270,166 | B2 * | 9/2007 | Jakus et al. | 164/45 |
| 7,958,932 | B2 | 6/2011 | Chaudhry et al. | |
| 2002/0088600 | A1 * | 7/2002 | Beeck | B22C 7/023 164/137 |
| 2004/0087754 | A1 | 5/2004 | Foley et al. | |
| 2009/0008058 | A1 * | 1/2009 | Chaudhry et al. | 164/456 |
| 2010/0294451 | A1 * | 11/2010 | Paul | B22C 7/026 164/28 |

* cited by examiner

FOAM PATTERN TECHNIQUES

CROSS REFERENCE TO RELATED APPLICATIONS

This application claims the benefit of U.S. Provisional Patent Application Ser. No. 61/583,221, filed Jan. 5, 2012, the disclosure of which is hereby incorporated by reference in its entirety.

STATEMENT REGARDING FEDERALLY SPONSORED RESEARCH OR DEVELOPMENT

This invention was made with government support under Contracts No. FA8650-05-M-5304 and No. FA8650-06-C-5300 awarded by U.S. Air Force. The Government has certain rights in this invention.

BACKGROUND

The present invention relates to casting processes for the manufacture of metal and alloy structures, and more particularly, to systems, methods and materials associated with fugitive patterns used for casting operations.

Investment casting, which is also commonly known as the lost wax process, is one of the oldest known techniques utilized for forming metal. In practice, a wax substance is patterned, such as by injecting melted wax into a die. When the wax cools, it solidifies in a pattern that corresponds to the component to be cast in metal. The molded wax pattern then is invested in a ceramic shell mold, such as by repeatedly dipping the wax pattern in a ceramic slurry until a desired thickness of ceramic material is built-up on the wax pattern. The shell mold is initially heated to remove the molded wax pattern and is then fired at an elevated temperature to develop appropriate mold strength for casting a molten metal or alloy.

There are several major limitations and potential problems with using wax to manufacture investment castings, especially when it comes to certain components, such as highly complex castings, large castings and/or castings with relatively thin cross-sections. For example, the dimensional accuracy of a part manufactured using a conventional investment casting process is limited due to the inherent distortion of the pattern that occurs in the processing of wax. Moreover, wax must be handled at room temperature or lower to prevent undesired wax characteristics and/or defects, such as shape distortion, fingerprints, creep, etc.

Still further, conventional wax costs are relatively high due to the requirement of initial melt cycle(s) necessary to melt the wax prior to injecting the wax into a corresponding die. Cost is further increased due to the relatively high scrap rates, which typically result due to metal leakage from shell mold cracks caused by wax expansion. Cost is also increased due to defects that lead to inclusions in the molten metal caused by ash content from wax reacting with the shell material.

BRIEF SUMMARY

According to aspects of the present invention, a method of assembling a fugitive foam pattern for use in investment casting operations is disclosed. The method comprises inserting a first portion from a mixture comprising polyol and isocyanate into a mold cavity of a first mold. The first mold corresponds to a first portion of an overall foam to be assembled. The method also comprises waiting for a predetermined time sufficient for a first reaction from the mixture to form a foam pattern structure corresponding to the first portion of the foam pattern, where the first portion includes a mating surface. The method further comprises exposing the mating surface of the first portion of the foam pattern structure to a mold cavity of a second mold corresponding to a second portion of the foam pattern. In this manner, the method yet further comprises inserting a second portion from the mixture into the mold cavity of the second mold corresponding to the second portion the foam pattern. Still further, the method comprises waiting for a predetermined time sufficient for a second reaction from the mixture to form a foam pattern structure corresponding to the second portion of the foam pattern such that the second reaction bonds the second portion to the mating surface of the first portion of the foam pattern structure.

According to further aspects of the present invention, a method of creating a fugitive foam pattern comprises mixing a polyol component and an isocyanate component to form a liquid mixture. The method also comprises placing a core in a cavity of a mold so as to be at least partially suspended from the cavity walls. The method further comprises inserting the mixture into the cavity of the mold so that the mixture flows into the cavity and surrounds at least a portion of the core. The method also comprises waiting for a predetermined time sufficient for a reaction from the mixture to form a foam pattern structure within the mold corresponding to the shape of the cavity of the mold, wherein the foam pattern structure encloses at least a portion of the core. Still further, the method comprises removing the foam pattern structure having the core therein, from the mold.

The method may further comprise using the mixture to form at least one expendable foam support structure. In this exemplary implementation, the method further comprises placing at least one expendable foam support structure in the cavity of a mold. In this regard, the core is placed in the cavity of the mold so as to be at least partially suspended from the cavity walls by at least one expendable foam support structure placed in the cavity. Also, the mixture is inserted into the cavity of the mold so that the mixture further flows into the cavity and surrounds at least a portion of each inserted expendable foam support structure. This method further comprises waiting for a predetermined time sufficient for the reaction from the mixture to integrate each expendable foam support structure into the foam pattern structure.

According to still further aspects of the present invention, a method of creating a foam pattern comprises mixing a polyol component and an isocyanate component to form a liquid mixture. The method also comprises placing a temporary soluble core having a shape corresponding to a desired feature of a resulting foam pattern in a cavity of a mold. The method further comprises inserting the mixture into the cavity of the mold such that the mixture flows into the cavity and surrounds a portion of the temporary core and waiting for a predetermined time sufficient for a reaction from the mixture to form a foam pattern structure within the mold corresponding to the shape of the cavity, where the foam pattern structure encloses around a portion of the temporary core. The method also comprises removing the foam pattern structure from the mold and removing the temporary core from the foam pattern structure independent of caustic chemical leaching such that the resulting foam pattern structure has the desired feature.

By way of example, placing a temporary soluble core may comprise placing a water-soluble core in the cavity of the mold. In this exemplary implementation, removing the temporary core comprises dissolving the water-soluble core in water. In yet another illustrative example, placing a temporary soluble core may comprise placing an acid-soluble core in the cavity of the mold. In this exemplary implementation, removing the temporary core comprises dissolving the acid-soluble core in citric acid.

DETAILED DESCRIPTION

Figure 1:
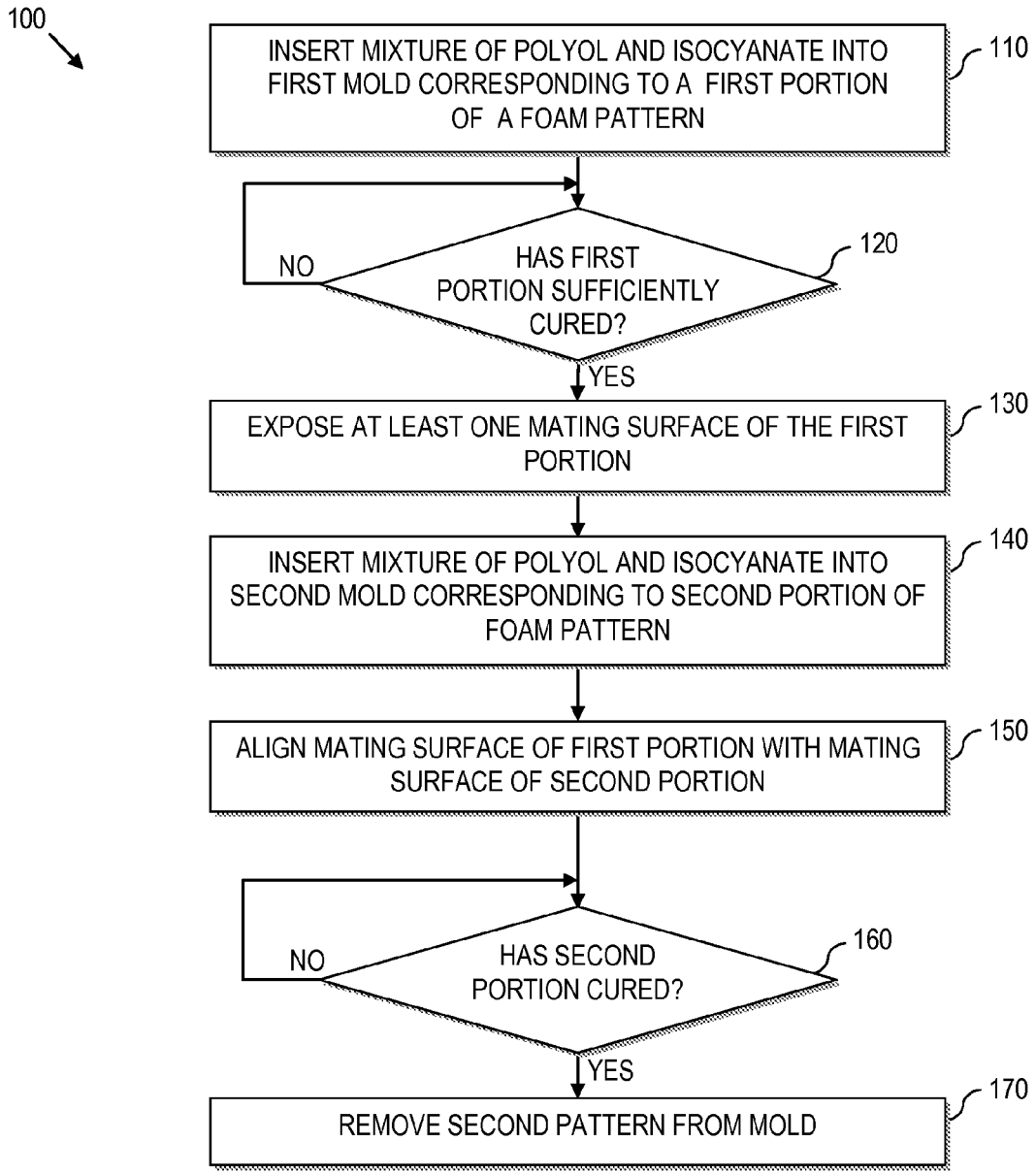
FIG. 1 is a flow chart illustrating a method of assembling a fugitive foam pattern, according to various aspects of the present invention.

In the following detailed description, reference is made to the accompanying drawings that form a part hereof, and in which is shown by way of illustration, and not by way of limitation, specific embodiments in which the invention may be practiced. It is to be understood that other embodiments may be utilized and that changes may be made without departing from the spirit and scope of the present invention.

The present invention provides methods and materials associated with foam patterns that are particularly suited for use in investment casting operations. According to an aspect of the present invention, a foam pattern for use in making a shell mold comprises a thermosetting polyurethane foam material specifically formulated for investment casting applications that is shaped to correspond to the cast article or component to be made.

To make the foam material, a polyol and an isocyanate are heated and combined to form a mixture. In some cases, the mixture includes a skin hardening agent, a catalyst, other additives, or a combination thereof. Various mixtures and techniques for formulating the foam pattern are as set out in greater detail in U.S. Pat. No. 7,958,932 by Chaudhry et al. entitled "CASTING MATERIALS" the entirety of which is incorporated by reference.

The foam material is inserted (e.g., hand poured, injected, etc.) into a cavity of a mold, where it expands slightly to fill the cavity of the mold. The foam is allowed to set up so as to harden (i.e., cure) over time to form a foam pattern. A release agent can be used to coat the cavity of the mold for easier release of the pattern from the mold, if necessary.

The foam pattern is removed from the cavity of the mold and is allowed to cool. Due to the formulation of the mixture, the resulting molded foam pattern exhibits a film-like surface that is free from surface-connected open pores of the polyurethane foam. Thus, the foam pattern is suitable for casting operations. The thickness of the outer surface of the foam pattern will likely depend upon processing conditions and the geometry of the corresponding pattern. However, the skin (i.e., outer surface) may be typically less than 0.001 inches (0.025 mm) thick. Moreover, the resulting pattern can be formulated to have an aggregate pattern density that exhibits sufficient stiffness, rigidity and smooth surface characteristics to be invested in a shell mold without damage to the pattern.

As a few illustrative examples, a foam pattern may exhibit an aggregate pattern density in the range of about 3 to 20 $lbs/ft^3$ (pounds per cubic feet) and may typically realize an aggregate density in the range of 4 to 8 $lbs/ft^3$, although other density ranges may be utilized depending upon the specific application. For instance, an aggregate pattern density may exceed 20 $lbs/ft^3$ where the dimensions of the pattern or the requirements of the pattern so require. Moreover, the dimensional stability of the resulting pattern enables the pattern to be stored for extended periods of time and shipped or otherwise transported using commercial means without damage to the foam pattern.

The foam pattern is typically utilized by a foundry to dip into a ceramic slurry to form a casting mold around the foam pattern. The skin or surface of the foam pattern should be continuous and unbroken so that the water/ceramic slurry cannot penetrate the pattern surface, thus avoiding fabrication problems such as shell cracking and/or preventing other defects in the cast metal or metal alloy components in future processes using the shell mold. Once a sufficient thickness of ceramic material is built up on the foam pattern, the shell mold is heated to a temperature sufficient to cause the foam pattern to burn out of the mold. The formulation and density of the foam pattern is configured so that the shell mold does not crack during the burn out removal of the foam pattern. Notably, the foam pattern material burns out cleanly, leaving no significant ash residue in the shell mold which can contaminate the molten metal or alloy which is poured in the shell to make the casting during subsequent processing.

Moreover, the structural integrity of foam pattern structures as described more fully herein, facilitates the use of thinner investment shells, thus reducing materials usage and energy consumption. As such, for example, when implementing investment casting operations, less dips into the slurry are required and thus thinner shells can be created, compared to traditional wax patterns used for conventional lost wax processes.

The foam pattern preparation and processing are described in greater detail in U.S. Pat. No. 7,958,932 by Chaudhry et al. entitled "CASTING MATERIALS", already incorporated by reference herein.

Foam Pattern Assemblies:

Referring to the Figures and in particular FIG. 1, a flow chart illustrates a method 100 for assembling a fugitive foam pattern suitable for investment casting, according to various aspects of the present invention. In general, the foam pattern is made by sequentially forming pattern sections together to build an overall foam pattern.

A first portion of the foam pattern is created by inserting a mixture comprising polyol and isocyanate into a mold cavity of a first mold at 110. The mixture is formulated in a manner suitable to create a fugitive foam pattern for investment casting as described above. Also, as mentioned above, in some embodiments the mixture further comprises additives such as, but not limited to, skin hardening agents, catalysts, other additives, or a combination thereof. Also, in various embodiments, the user inserts the mixture by hand pouring the mixture into the mold. However, the mixture may also be injected, such as by using a reaction injection molding (RIM) machine, or by using other methods of inserting the mixture into the mold.

As used throughout this disclosure, each mold may comprise one or more sections or components. For instance, the mold may comprise mating clamshell halves, sections that fit or otherwise lock together, or other arrangements necessary to form the desired pattern. Moreover, clamps and other features may be utilized to secure the mold during use. Still further, knockout pins, wax, release agents and other features may be utilized to release the foam pattern from the associated mold.

The method also comprises waiting for a predetermined time sufficient for a first reaction from the mixture to form a foam pattern structure corresponding to the first portion of the foam pattern. For instance, at 120, a determination is made as to whether or not the first portion has sufficiently cured. By sufficiently cured, it is meant that the mixture has formed into a foam pattern structure having characteristics described more fully herein. Thus for instance, a determination is made as to whether the operation has waited for a predetermined time sufficient for a reaction from the mixture to form a foam pattern structure corresponding to cavity of the first mold. In this regard, the foam pattern need not be entirely cured. Rather, there may be some amount of a reaction still taking place when the determination at 120 is satisfied. If the first portion has not sufficiently cured, then the method 100 loops back to 120. On the other hand, if the first portion has sufficiently cured, then the method 100 proceeds onto 130. The first portion is constructed so as to have a mating surface that will be used assemble the first portion in to the overall foam pattern, as will be described in greater detail herein.

The method further comprises exposing the mating surface of the first portion of the foam pattern structure at 130. For instance, at least one mating surface of the first portion of the foam pattern may be exposed by removing the cured first portion from the mold. In alternative embodiments, the first mold, or a portion of the first mold stays in place while a portion of the first mold is removed, thus exposing the first mating surface. Additionally, the exposure of the first mating surface at 130 can be carried out by an operator, machine, automated process or any other form.

By way of illustration, the method may be carried out by inserting more of the mixture comprising polyol and isocyanate into a mold cavity of a second mold corresponding to a second portion of the foam pattern at 140. The second mold cavity thus has a shape corresponding to the second portion the foam pattern. As mentioned above, in various embodiments, the mixture is poured into the mold, e.g., by hand. Alternatively, the mixture may be injected or otherwise inserted by utilizing other methods as described more fully herein.

At 150, before the second portion has fully cured, the user aligns the mating surface of the first portion with the cavity of the second mold such that the first mating surface of the first portion is exposed to the cavity of the second mold. In this regard, the first mating surface of the first portion acts as an interior surface of the second mold. Typically, the user aligns the mating surface of the first portion with the cavity of the mold before inserting the mixture into the second mold. However, under certain implementations, certain adjustments may be carried out, e.g., by securing clamps, aligning the second mold over or otherwise to a jig or guide, etc. As another illustrative example, the second mold may comprise an open face that will align with the mating surface of the first portion after the mixture is inserted into the second mold.

The method 100 also comprises waiting for a predetermined time sufficient for a second reaction from the mixture to form a foam pattern structure corresponding to the second portion of the foam pattern such that the second reaction bonds the second portion to the mating surface of the first portion of the foam pattern structure.

More particularly, at 160, a determination is made as to whether or not the second portion has cured. If the second portion has not cured, then the method 100 loops back to 160. The second mold is configured so as to expose the mold cavity to the first mating surface of the first portion of the foam pattern. In this regard, as the mixture in the second mold cures, the composition of the liquid mixture in the second mold will integrate with the first mating surface (of the already formed first portion) to create an integral, single foam pattern.

More particularly, as the liquid mixture comprising polyol and isocyanate is inserted, e.g., poured, hand poured, injected, etc., into the second mold, the liquid abuts against the mating surface of the first portion (which is now a solid foam structure). The chemical reaction that takes place within the second mold forms the second portion of the overall foam pattern to its desired shape, e.g., as defined by the mold cavity of the second mold. Moreover, the chemical reaction that takes place in the second mold also integrally adheres the second portion of the overall foam pattern to the mating surface of the first portion, thus extending the overall foam pattern.

Thus for instance, when the mixture in the second mold forms a foam pattern structure corresponding to the second portion, a mating surface of the second portion within the second mold attaches to the mating surface of the first portion. Thus, a second portion of the overall foam pattern is subsequently molded adjacent to the first portion.

If the second portion has cured (and thus mated with the first portion), then the method proceeds onto 170. Thus, in an illustrative exemplary implementation, the process 100 waits a predetermined time, e.g., until sufficient time has passed to form a foam pattern structure corresponding to the second portion.

Once the method 100 has reached 170, the user removes the cured second portion from the second mold in any acceptable manner. In some embodiments, the pattern can continue to be built out until a desired overall foam pattern is achieved.

In certain illustrative embodiments, the second mold is used to form a portion of the pattern that is identical to the portion formed by the first mold. In such implementations, the first mold may be reused as the second mold, e.g., where repeating sections are to be combined, or otherwise where a portion of the mold can be removed to expose a section of the mold cavity that aligns in register with a mating surface of a previously formed portion. In still further embodiments, the first and second molds can be different, e.g., to create different structures that form a part of a larger, overall foam pattern.

In order to complete the overall foam pattern, one or more different molds, jigs, mixtures, pour techniques, etc., may be utilized. Moreover, utilizing this construction process, no additional materials such as glue, adhesive, or other bonding material are required to create the overall foam pattern because the chemical reaction that takes place in the polyol and isocyanate liquid mixture as it forms into a foam structure integrally bonds with the foam pattern portions of previously formed foam pattern portions that are exposed to the liquid mixture. In this regard, the final overall foam pattern is an integral unit. This process allows pattern shapes to be assembled which cannot otherwise be constructed, or which otherwise would be difficult to construct using a single mold for the overall pattern.

According to further aspects of the present invention, two or more portions of the foam pattern are separately formed, e.g., using the first mold as set out at 110. The portions of the foam pattern are then positioned adjacent to each other such that complimentary mating faces align in register with one another. The second mold is positioned so as to form a cavity about the seam of the two portions. Under this arrangement, the method comprises inserting the mixture comprising polyol and isocyanate into a mold cavity of the second mold so as to allow the mixture to integrally bond the two portions along the complimentary mating faces.

Figure 2A:
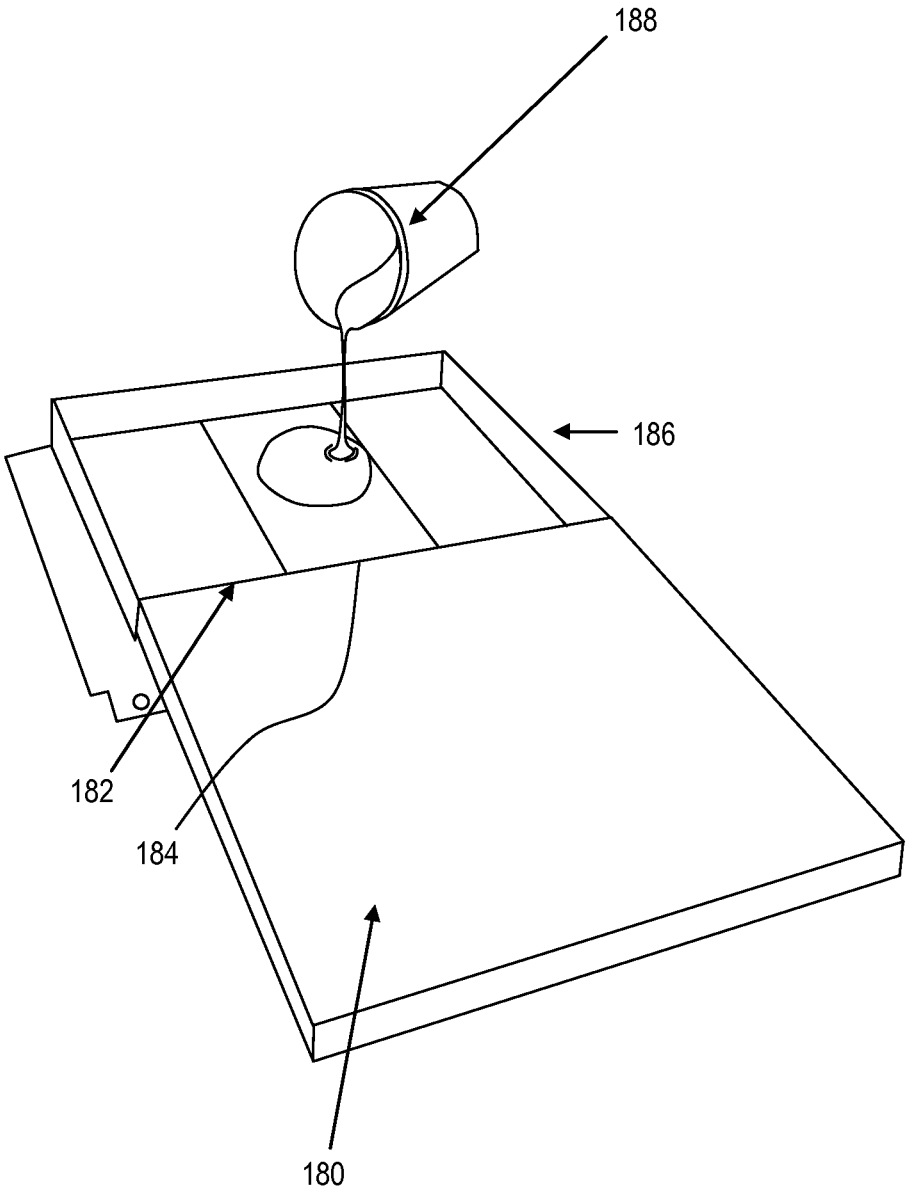
FIG. 2A is a view of hand pouring a mixture into a mold such that a first portion of a pattern, which has already been formed, is exposed to the mold cavity of a second portion, according to various aspects of the present invention.

Referring to FIG. 2A, a foam pattern is being assembled, e.g., according to the method of FIG. 1. In FIG. 2A, a first portion 180 of an overall foam pattern is already formed using a first mold (which was removed from the foam pattern as depicted—thus the first mold is not illustrated in FIG. 2A). The first portion has a mating surface 182 which extends along the edge 184 of the first portion. The mating surface 182 of the first portion can have any desired surface contour. A second mold 186 is positioned adjacent to the first portion. In this regard, the second mold 186 exposes its cavity to the mating surface of the first portion 180. Thus, the mating surface of the first portion actually defines an interior cavity feature of the second mold 186. The mixture 188 comprising polyol and isocyanate is illustrated as being hand poured into the mold cavity of the second mold 186.

Figure 2B:
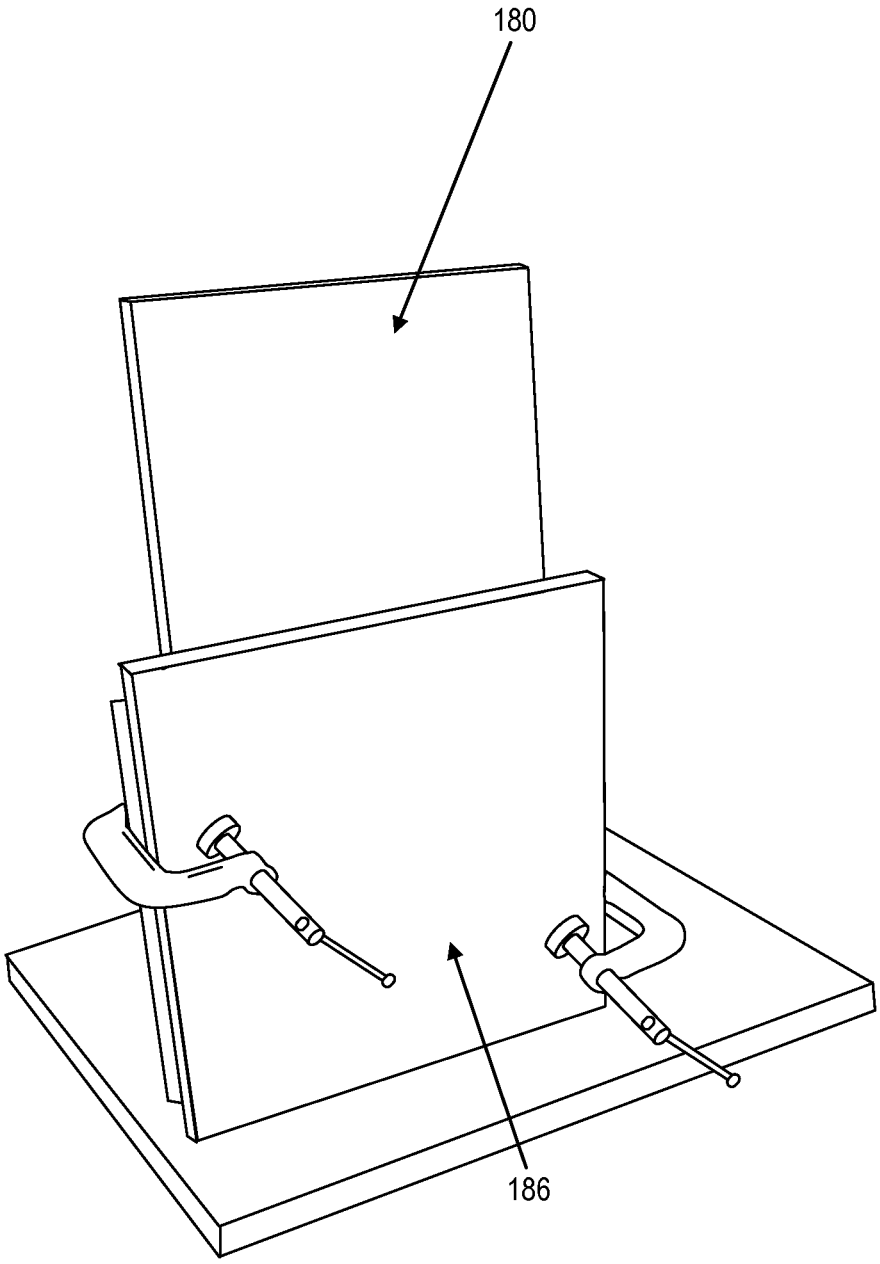
FIG. 2B is a view of the pattern according to FIG. 2A, where the mold is clamped down while the mixture cures into the second portion of the foam pattern.

Referring to FIG. 2B, the second mold 186 is clamped together while the mixture poured into the second mold forms a second portion of the overall desired foam pattern.

Figure 2C:
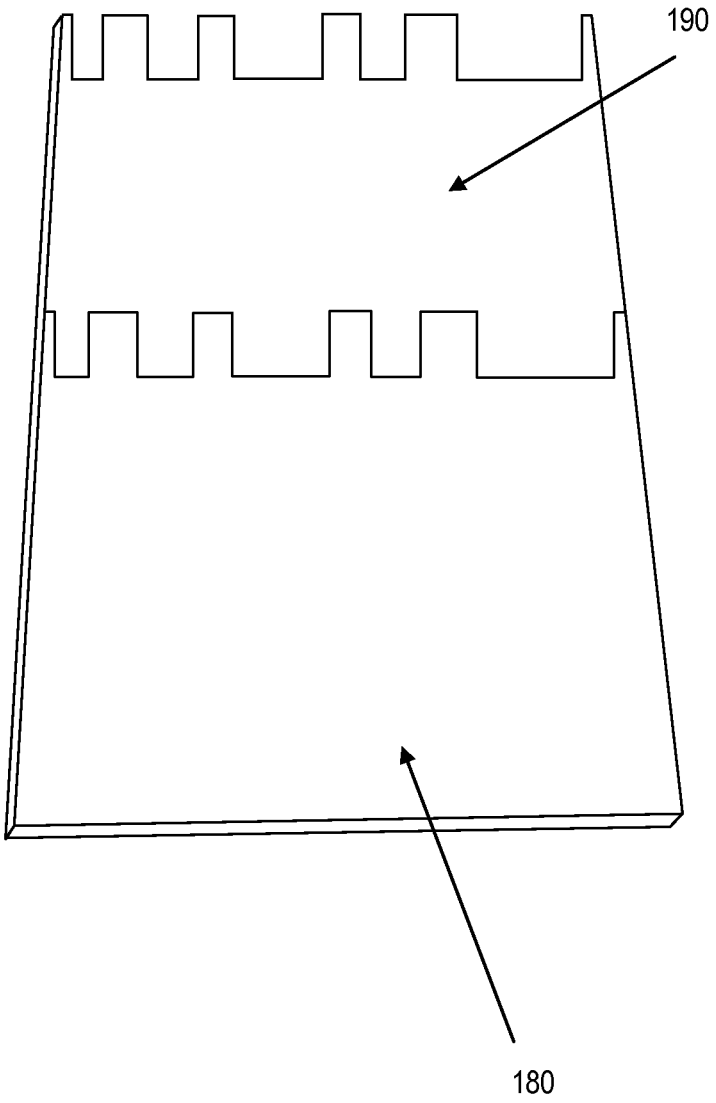
FIG. 2C is a view of the pattern according to FIG. 2A, where the second portion is removed from the mold, showing two sections of the overall foam pattern that are formed together as an integral pattern, according to aspects of the present invention.

Referring to FIG. 2C, the first portion of the overall foam pattern is illustrated integrally joined to the second portion 190 of the foam pattern after the second portion 190 is removed from the second mold 186 (not shown in FIG. 2C).

Figure 2D:
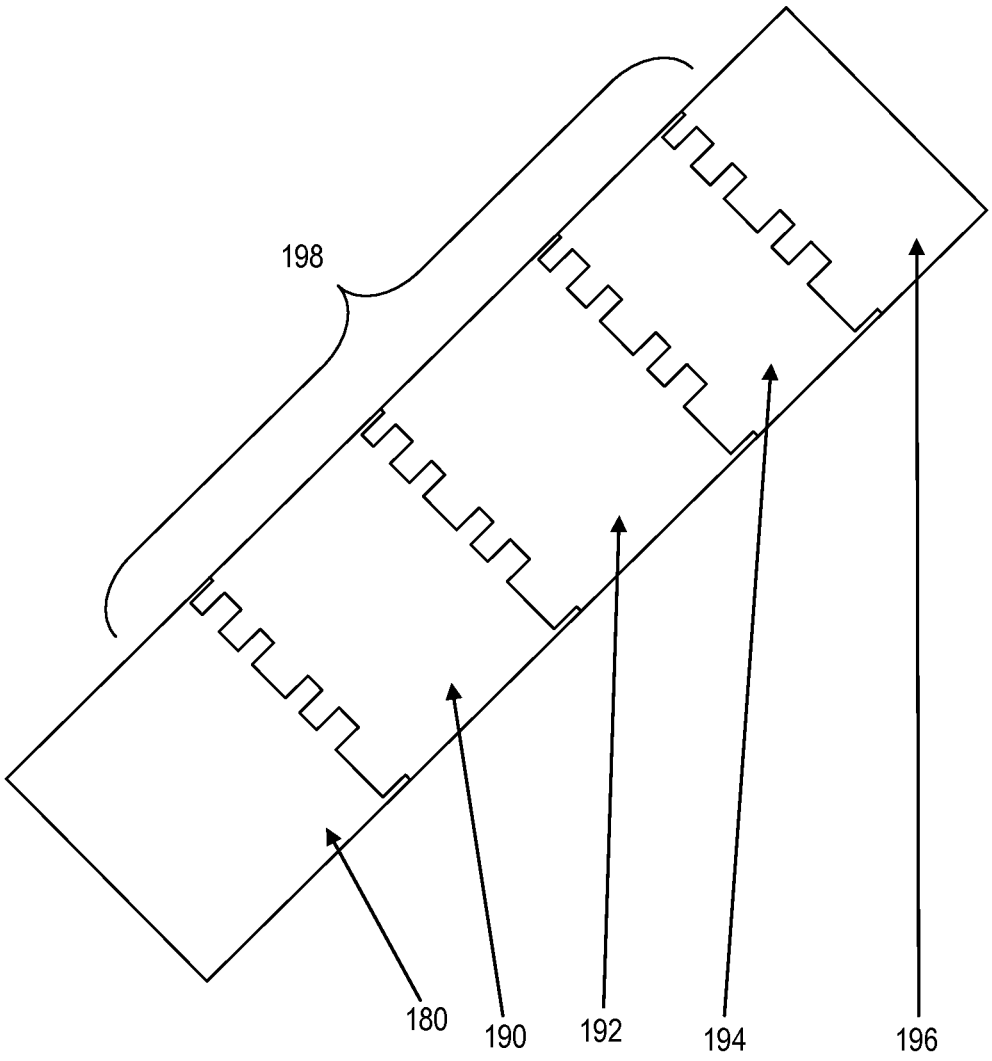
FIG. 2D is a view of an overall foam pattern created using the assembly approach of FIGS. 2A-2C, according to aspects of the present invention.

Referring to FIG. 2D, for purposes of illustration, several portions 180, 190, 192, 194, 196 are illustrated as formed together into a unitary foam pattern, e.g., by repeating the molding process of FIG. 1 for each new portion.

Figures 2E, 2F:
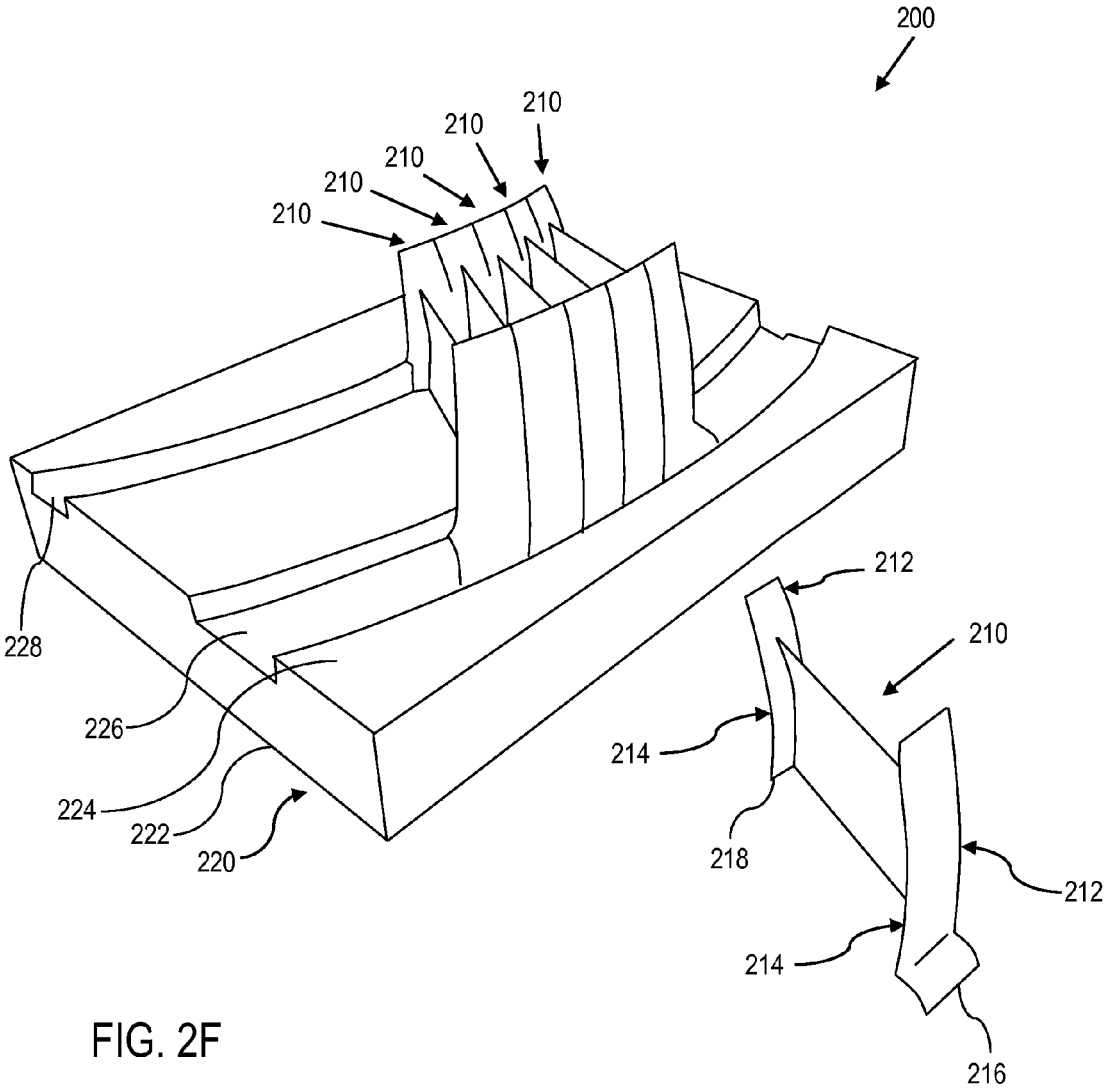
FIG. 2E is perspective view illustrating a portion of an illustrative foam pattern, wherein the portion includes a mating surface, according to various aspects of the present invention.
FIG. 2F is a perspective view illustrating use of a mating surface with a guide according to various aspects of the present invention.

Referring now to FIGS. 2E and 2F, schematics illustrate the use of a guide to assist in assembling a foam pattern according to various aspects of the present invention. A partially completed foam pattern 200 is illustrated. A foam pattern may take any desired shape. The following example is for illustration only and should not be considered limiting. The concepts, features, methods and structures described herein apply to many different desired patterns.

Referring specifically to FIG. 2E, a section 210 of the desired pattern 200 is illustrated broken out from the overall foam pattern to demonstrate an exemplary configuration of a repeating pattern. The stand-alone portion 210 has a first mating surface 212, a second mating surface 214, a first guide-runner 216, and a second guide-runner 218. As mentioned above, the mating surfaces 212, 214 are utilized to join separate, adjacent instances of the repeating pattern portion to assemble the overall foam pattern 200.

Referring now to FIG. 2F, in the illustrative example, a guide 220 is used to hold the foam pattern portions during assembly, e.g., to maintain proper alignment of each portion. However, the use of a guide 220 is not necessary in all applications. The guide 220 in this exemplary implementation is only partially illustrated to demonstrate aspects of an embodiment of the present invention. The guide 220 is shown in more detail in FIG. 3. As illustrated, the guide 220 includes a frame 222 supporting a major surface 224. A first channel 226 and a second channel 228 are provided through the first major surface 224.

The guide 220 is utilized to assemble a plurality of instances of the repeating section 210. In this regard, a plurality of instances of the section 210 are assembled serially by forming one instance at a time. Alternatively, sections can be sub-assembled, and the subassemblies can be subsequently joined using techniques as described more fully herein.

According to the method 100 of FIG. 1, a first instance of section 210 is formed in a mold (not illustrated in FIG. 2F) and is allowed to cure. In certain embodiments, the first instance of the section 210 is removed from the mold. In alternative embodiments some portion of the mold may be left in place temporarily, as described more fully herein.

The user or some automated process positions the first section 210 on the guide 220 such that the first guide-runner 216 of the first portion 210 is positioned in the first channel 226 of the guide 220 and the second guide-runner 218 of the first section 210 is positioned in the second channel 228 of the guide 220.

The user then continues with the method 100 of FIG. 1 and inserts the mixture into a second mold (not shown) corresponding to the second instance of section 210 of the desired pattern 200. In this exemplary case, the second instance 210 is identical to the first instance 210. However, as mentioned above, it is not required that the portions be identical.

The second mold is positioned such that the first mating surface 212 of the second instance aligns with the second mating surface 214 of the first instance 210. While the second instance is curing, it mates with the first instance to form a continuous structure.

Figure 3:
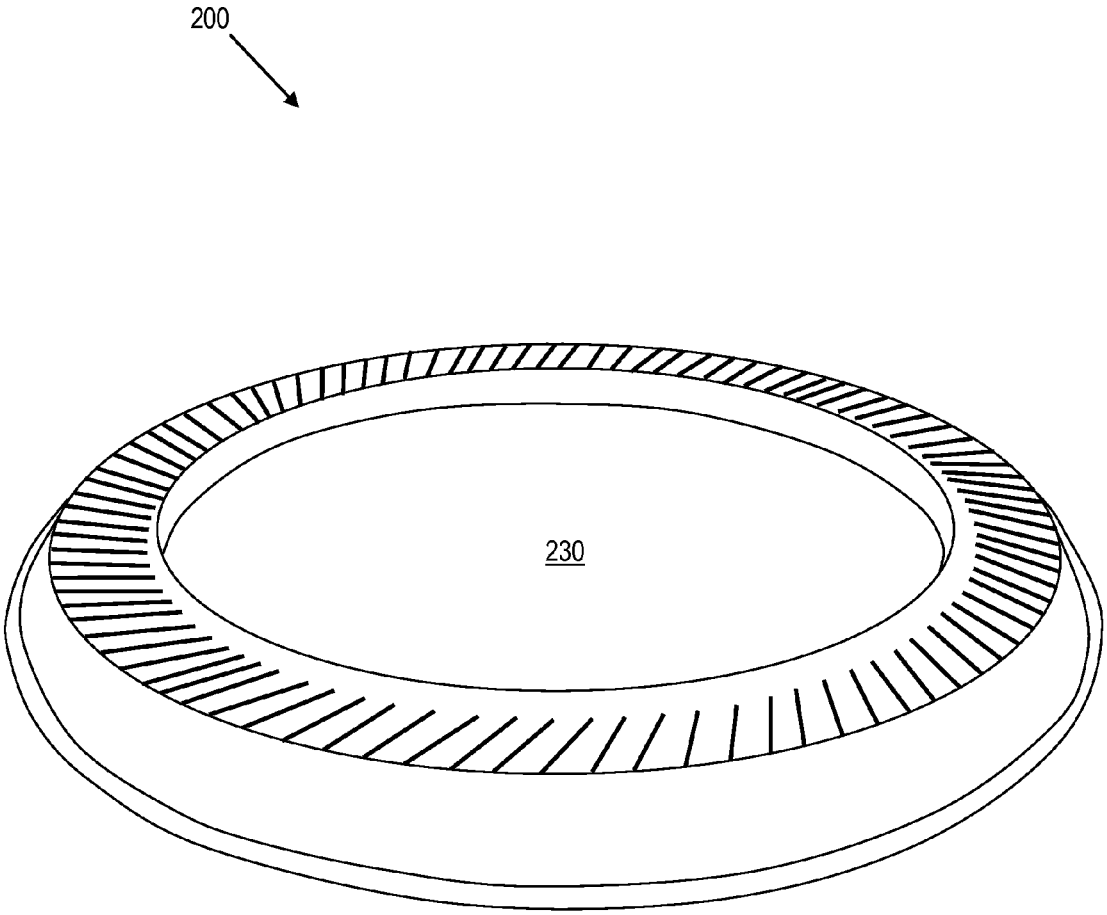
FIG. 3 is a view illustrating use of the mating surface in a completed repeating pattern and using a guide according to various aspects of the present invention.

The above process is repeated until the desired overall pattern is realized. FIG. 3 illustrates the completed exemplary foam pattern 200 where a plurality of sections are mated together using the guide 220.

Creating a foam pattern in portions provides several benefits over traditional foam pattern creation methods. For example, in a foam pattern with several repeating portions, the number of molds, the complexity of the molds, the overall size of the molds, or combinations thereof is reduced. Further, because the portions of the casting pattern are smaller than the entire casting pattern, any defect on a portion results in a smaller amount of waste than if the defect was on the larger complete casting pattern. Further, shapes can be assembled that would not otherwise be possible with a single mold. In this manner, the complexity and shapes of the portions will likely dictate the approach utilized for assembling the foam pattern.

According to various aspects of the present invention, a pattern pour is thus disclosed to create single-piece foam patterns. In this regard, large patterns are created using a construction process that sequentially joins foam pattern sub-assemblies. More particularly, a composite pattern is formed by pour molding a portion of the overall pattern to a previously formed adjacent portion so that the chemical reaction that takes places within a current mold integrally adheres the foam to an adjacent section of foam which was previously formed.

Foam Patterns with Cores:

The foam pattern material according to various aspects of the present invention eliminates the requirement for a chemical soluble core, e.g., a leachable wax which can be used as a core to create a cavity within a wax pattern. Rather, a leachable wax core is replaced with a lower melting wax to melt out of the foam pattern material independent of chemical leaching, to create a core feature such as a cavity inside the pattern. As such, no chemical bath is required for the investment cast parts, such as would conventionally be utilized when making hollow parts, etc.

According to still further aspects of the present invention, the temporary core is made of any suitable material that can be removed without requiring caustic chemical leaching. For instance, in certain illustrative embodiments, the temporary core comprises an acid-soluble material (e.g., soluble in mild citric acid bath) or a water-soluble material as an alternative to a low melting point wax.

Figure 4:
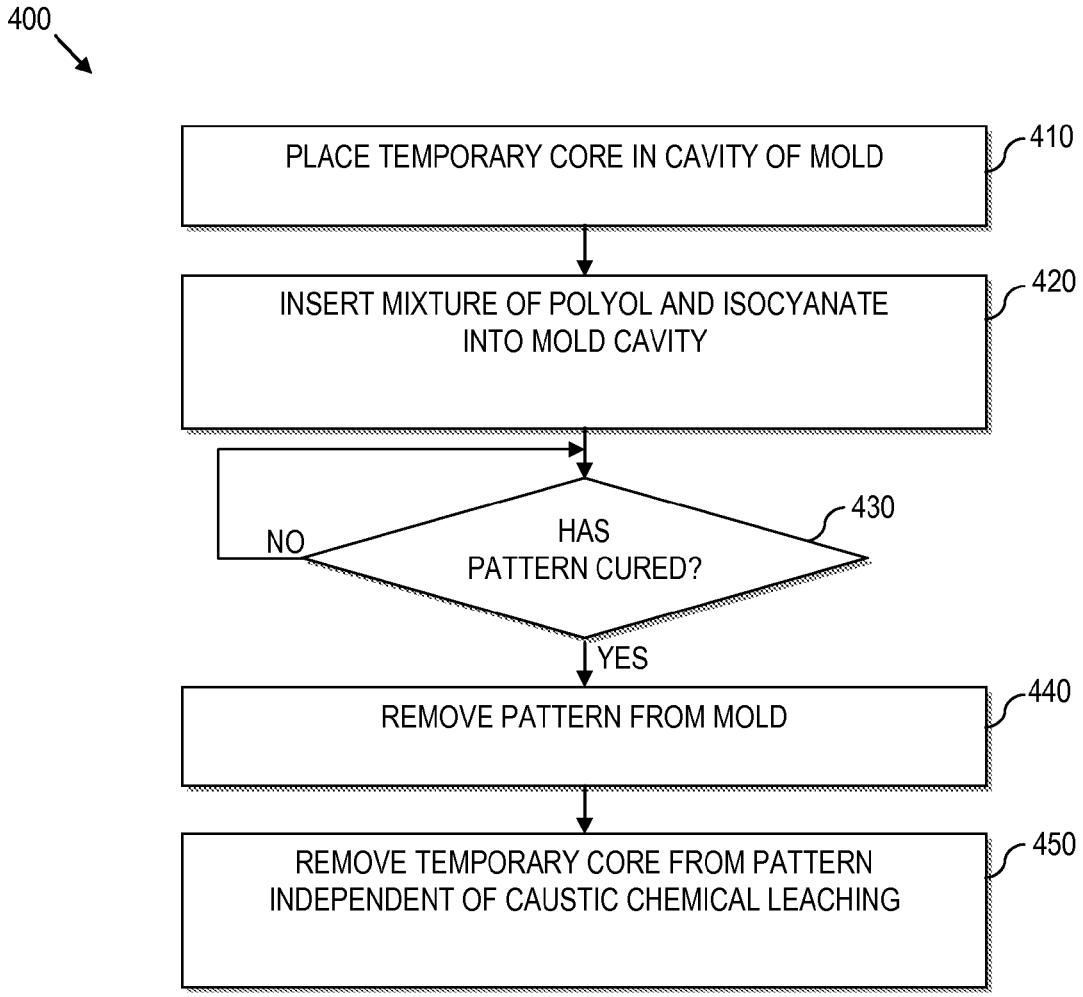
FIG. 4 is a flow chart illustrating a method of creating a foam pattern with a channel, according to various aspects of the present invention.

Referring now to FIG. 4, a flow chart illustrates a method 400 of creating a foam pattern with an internal feature that extends to at least one surface of the foam pattern, according to various aspects of the present invention. The method 400 may be usable for example, in building a foam pattern such as a pipe, elbow or other structure having a channel, aperture, cavity, passageway or other feature, extending from the outer surface of the foam pattern at least partially into or otherwise through the foam pattern. Initially, a polyol component and an isocyanate component are mixed to form a liquid mixture as set out in greater detail herein. The mixture can be prepared using any of the techniques, formulas, compositions, methods, etc., as set out more fully herein. As mentioned above, in some embodiments the mixture further comprises additives such as, but not limited to, skin hardening agents, catalysts, other additives, or a combination thereof.

At 410, a user places a temporary core with the shape of a desired feature of a resulting foam pattern in a cavity of a mold. In certain illustrative embodiments, the temporary core is made of any suitable material that can be removed without requiring chemical leaching, such as a low-melting point wax. Alternatively, the temporary core is made of any suitable material that can be removed without requiring caustic chemical leaching. For instance, in certain illustrative embodiments, the temporary core comprises an acid-soluble material (e.g., soluble in mild citric acid bath) or a water-soluble material as an alternative to a low melting point wax.

At 420, the user inserts the mixture comprising polyol and isocyanate into a mold cavity of a mold corresponding to the foam pattern. The mixture flows into the cavity of the mold and surrounds a portion of the temporary core. For instance, in a hand-pouring operation, the mixture is poured into the mold so as to flow around the core within the mold, thus allowing the foam pattern to form around the temporary core. As noted in greater detail herein, in various embodiments, the user inserts the mixture by hand pouring the mixture into the mold. However, the mixture may be injected using a RIM machine, or by using other methods of inserting the mixture into the mold.

At 430, a determination is made on whether or not the pattern has cured. If the pattern has not cured, then the method 400 loops back to 430. On the other hand, if the pattern has cured, then the method 400 proceeds onto 440. Thus, the method 400 waits a predetermined time, e.g., sufficient for a reaction from the mixture to form a foam pattern structure within the mold corresponding to the shape of the cavity, wherein the foam pattern structure encloses around a portion of the temporary core.

Once the method 400 has reached 440, a user removes the cured pattern with the temporary core from the mold. The pattern can be removed from the mold using any number of suitable techniques. At 450, the temporary core is removed from the pattern without using (independent of) caustic chemical leaching such that the resulting foam pattern structure has the desired feature.

The process for removing the temporary core depends on the materials used to make the temporary core. In certain embodiments that utilize a low-melting point wax core, the pattern (including the temporary core) is heated above the melting point temperature of the wax but below the distortion temperature of the foam pattern. Thus, the temporary core is removed from the foam pattern structure independent of chemical leaching by using heat. For example, in exemplary embodiments, a low-melting point wax has a melting point of up to 200 degrees Fahrenheit (approximately 93.3 degrees Celsius). The foam pattern does not distort or burn at such a low temperature. For example, the thermoset rigid foam pattern, as set out herein, requires a temperature in excess of approximately 300 degrees Fahrenheit (approximately 149 degrees Celsius) to begin to distort. Moreover such foam patterns burn out above approximately 1,200 degrees Fahrenheit (approximately 649 degrees Celsius).

Thus, for example, using the parameters above, a foam pattern having a temporary low melting point wax core is heated to a temperature between the melting point of the temporary core and the distortion temperature of the foam pattern, e.g., to 250 degrees Fahrenheit (approximately 121 degrees Celsius), which is between the melting point of the wax (200 degrees Fahrenheit—approximately 93.3 degrees Celsius) and the distortion temperature of the foam pattern, e.g., 300 degrees Fahrenheit (approximately 1489 degrees Celsius), in the non-limiting illustrative example. As such, the wax defining the core is melted out from the pattern, but the foam pattern remains otherwise dimensionally stable.

Notably, where the temporary core is low melting point wax, no chemical leaching is required to remove the temporary core from the foam pattern. Also, due to the temperature stability of the foam pattern, low heat will not distort the foam pattern making it suitable for use with low melting point wax. Also, due to the relatively higher density smooth skin, closed cell structure and other characteristics of the foam pattern, liquids, e.g., used to wash or otherwise clean the foam pattern, will not distort or otherwise compromise the structure of the foam pattern.

As further examples, in embodiments with a water-soluble core, the pattern (including the temporary core) is dipped into water, or alternatively, water is otherwise applied to the foam pattern, such that the water dissolves the temporary core leaving the desired internal feature or cavity in the pattern. In certain embodiments with a mild acid-soluble core, the pattern (including the temporary core) is dipped into citric bath, or alternatively, citric solution is otherwise applied to the foam pattern such that the citric solution dissolves the temporary core leaving a feature in the pattern without harming the foam pattern.

Notably, regardless of whether the temporary core is low melting point wax, water-soluble or citric acid soluble, no caustic chemical leaching is required to remove the temporary core from the foam pattern. Moreover, where the core is a low melt wax core, no chemical leaching is required of any form to remove the temporary core.

Still further, due to the higher density smooth skin, closed cell structure, and other characteristics of the foam pattern, water, citric acid and other non-caustic chemical leaching components will not distort or otherwise compromise the structure of the foam pattern.

The method 400 (FIG. 4) allows for a feature, e.g., including a thin-walled feature, such as a channel, void, slot, cavity, opening, passageway, etc., to be present in a foam pattern, without using chemical leaching. Thus, various aspects of the present invention allow for the creation of a foam pattern with a feature without the use of caustic chemicals.

Figure 5:
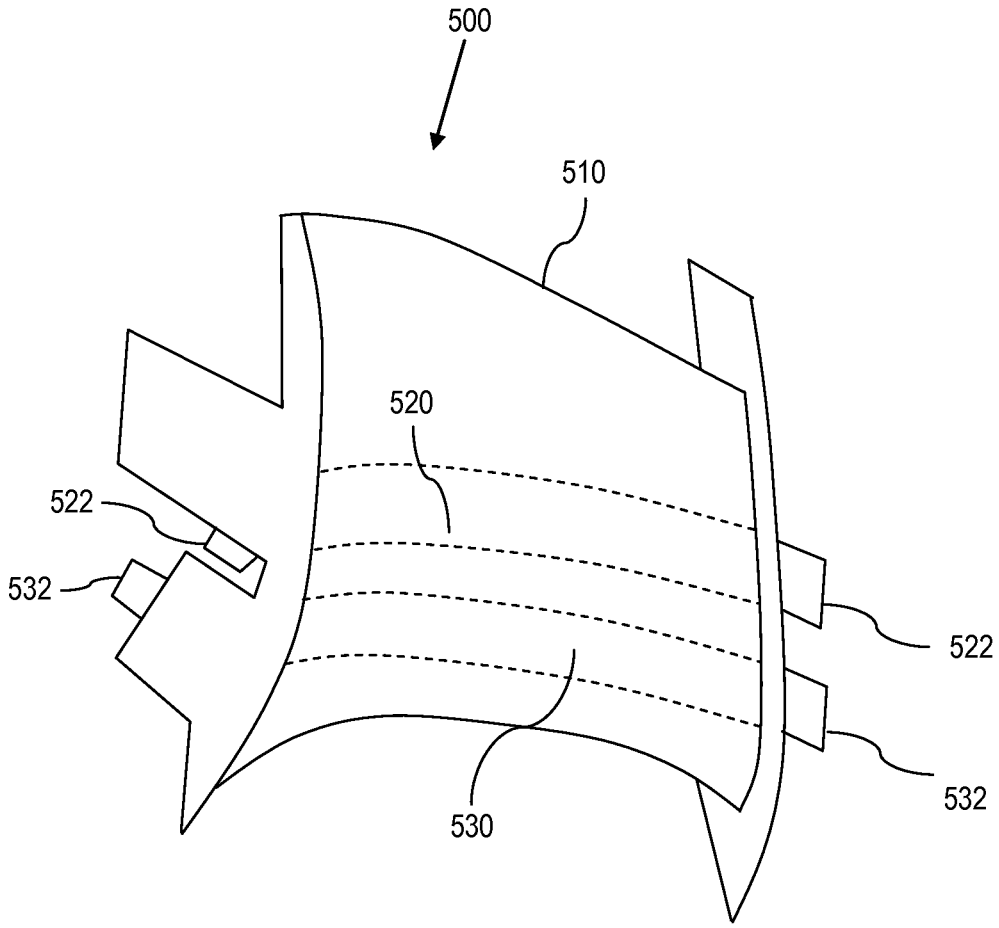
FIG. 5 is a front view illustrating use of a low-melting point wax core to create a channel in a foam pattern according to various aspects of the present invention.

Referring now to FIG. 5, a schematic illustrates use of low-melting point wax cores to create channels in a foam pattern 500 according to various aspects of the present invention. The following example is for illustration only and should not be considered limiting. The general concept of implementing a feature such as a channel in a foam pattern applies to many different desired patterns.

A foam pattern 510 includes a first channel 520 and a second channel 530. The user implements the method 400 of FIG. 4 to create the pattern 510. Specifically, the user inserts a first low-melting point wax core 522 in a mold. As can be seen, the first wax core 522 sticks out both ends of the pattern 510, during an intermediate step but passes through the pattern 510 to form a channel therethrough. Analogously, the user inserts a second low-melting point wax core 532 in a mold. As can be seen, the second wax core 532 sticks out both ends of the pattern 510, during an intermediate step but passes through the pattern 510 to form a channel therethrough. The user then inserts a mixture into the mold and allows the mixture to cure. After the foam pattern 510 is cured, the user removes the foam pattern from the mold. At that point, the resulting foam pattern 510 includes the wax cores 522, 532 filling and otherwise forming the desired channels 520, 530 respectively as illustrated in FIG. 5.

The user heats the pattern 510 to a temperature above the melting point of the wax cores 522, 532 but below the distortion temperature of the foam 510. The wax cores 522, 532 melt away and leave only the desired channels 520, 530 in the foam pattern 510. Thus, channels 520, 530 are made in a foam pattern 510 without the use of chemical leaching. Although the example of heat is used for purposes of discussion, water, citric acid or other non-caustic approaches may alternatively be utilized.

Figure 6:
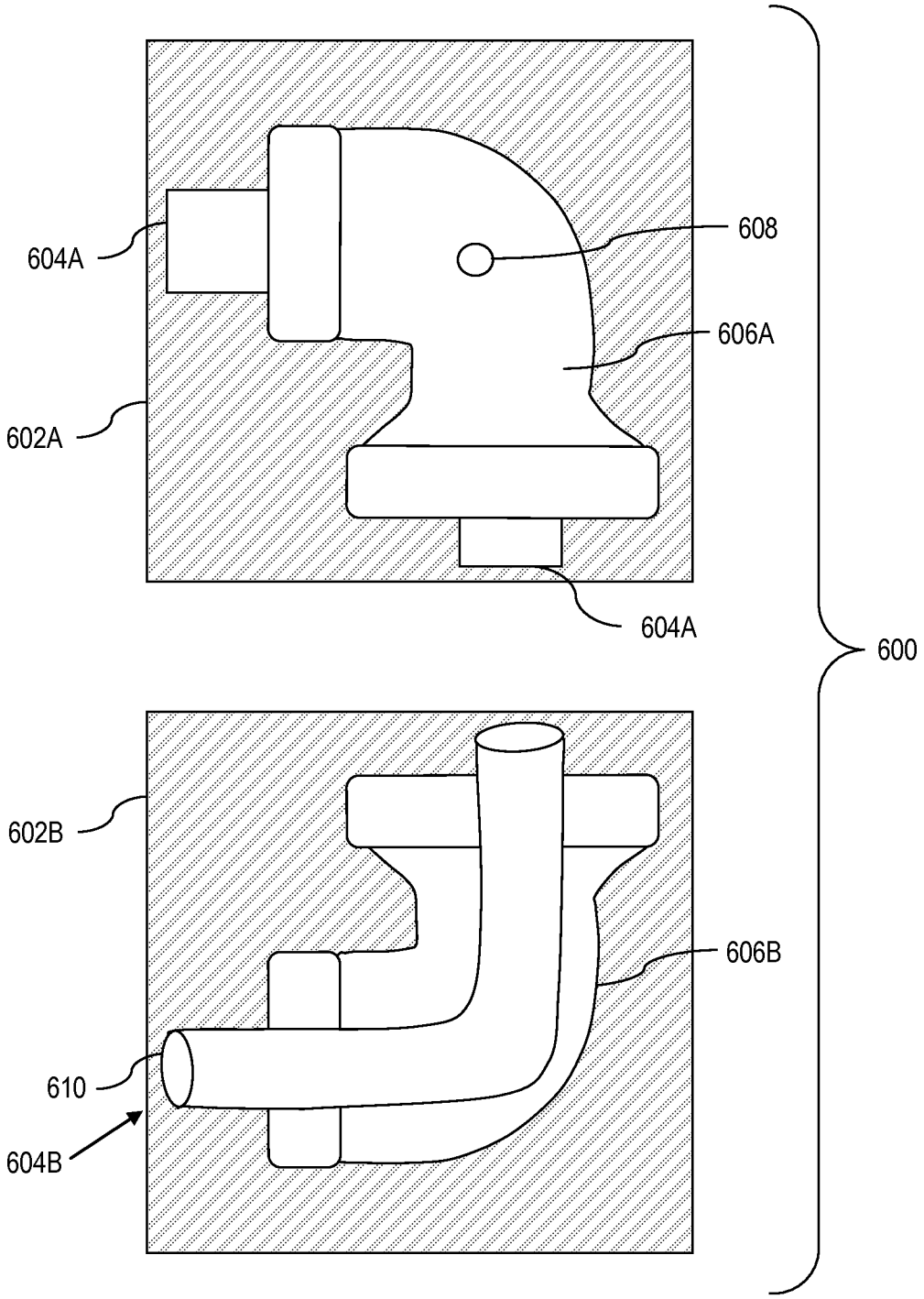
FIG. 6 is an illustration of an opened mold showing two mold halves opened up exposing the mold cavity to illustrate a temporary core inserted into the cavity before the cavity is filled with a mixture to form a foam pattern structure, according to aspects of the present invention.

Referring now to FIG. 6, a mold 600 is implemented as a clamshell mold comprising two mating halves, including a first half 602A and a second half 602B. The first and second mold halves 602A, 602B are shown opened up so that the internal cavity of each is exposed to illustrate certain aspects described more fully herein.

The first half 602A of the mold 600 includes an optional channel 604A for receiving a core print portion of a core, e.g., a temporary core. Similarly, the second half 602B of the mold 600 includes an optional channel 604B for receiving the core print portion of the core (described more fully herein). The first half 602 of the mold 600 also includes an internal cavity 606A. The internal cavity 606A is shaped as an impression of a bisected half of a desired structure. The first half 602A may also include an aperture 608, which is optional and may be provided as a through hole from the outside of the first half 602A into the cavity 606A so that the mixture, including the polyol component and the isocyanate component, can be poured, e.g., hand-poured, into the mold during a pattern forming operation.

In an analogous manner, the second half 602B of the mold 600 includes an internal cavity 606B that is shaped as an impression of the opposite bisected half of the desired structure relative to the cavity 606A of the first half 602A of the mold 600. In this regard, when the first half 602A and the second half 602B are mated together, the overall mold cavity defines the desired shape of a foam pattern structure to be formed.

In the illustrative, but non-limiting example, the mold 600 is used to form an elbow. The non-limiting, but illustrative elbow includes a channel passageway that extends entirely through the elbow. As such, a temporary core 610, e.g., in the shape of the internal feature of the desired passageway through the elbow, is laid into the channel 604B of the second mold half 602B. Notably, in the illustrative example, the core 610 sticks outside of the pattern defined by the cavity, but is held inside of the mold. As such, the business portion of the core 610 will be exposed to a mixture that produces the foam pattern, and the ends of the core, i.e., the core print, will extend from the pattern to support the core 610 in a desired position during pattern forming operations.

By way of illustration, and not by way of limitation, a method of creating a foam pattern, e.g., an elbow or other desired foam pattern structure is implemented by mixing a polyol component and an isocyanate component to form a liquid mixture. The mixture includes any necessary additional components. For instance, the mixture may be formulated by also adding a skin-forming agent to the mixture, etc. In practice, the mixture can be formulated using any of the techniques set forth more fully herein.

A temporary core having a shape corresponding to a desired feature is placed in a cavity of a mold. For instance, as illustrated, the generally cylindrically shaped temporary core 610 is inserted into the channel 604B. This temporary core 610 will create a feature that extends from the surface of the foam pattern and extends through the foam pattern when the foam pattern is formed, as will be described in greater detail below. However, in practice, the feature need not extend entirely through the foam pattern. Rather, for instance, the feature can extend from the surface of the foam pattern into the internal volume of the foam pattern.

In this regard, once the temporary core 610 is installed in the channel 604B, the first half 602A of the mold 600 is mated with the second half 602B of the mold 600. Once assembled, the core print of the temporary core 610 will extend from the pattern within the mold. After assembling the mold 600, the mixture is inserted into the cavity of the mold 600. For instance, the mixture can be inserted to flow into the cavity so as to surround a portion of the temporary core, e.g., by hand pouring the mixture through the opening aperture 608 in the first mold half 602A. Once the mixture is inserted into the mold, the method waits for a predetermined time sufficient for a reaction from the mixture to form a foam pattern structure corresponding to the cavity of the mold, wherein the foam pattern structure encloses a portion of the temporary core. In this manner, the temperature of the mold 600, the temperature and other parameters of the mixture, etc., are controlled so that the reaction of the mixture does not cause the temporary core to deform or otherwise deviate significantly from the desired feature shape.

Figure 7:
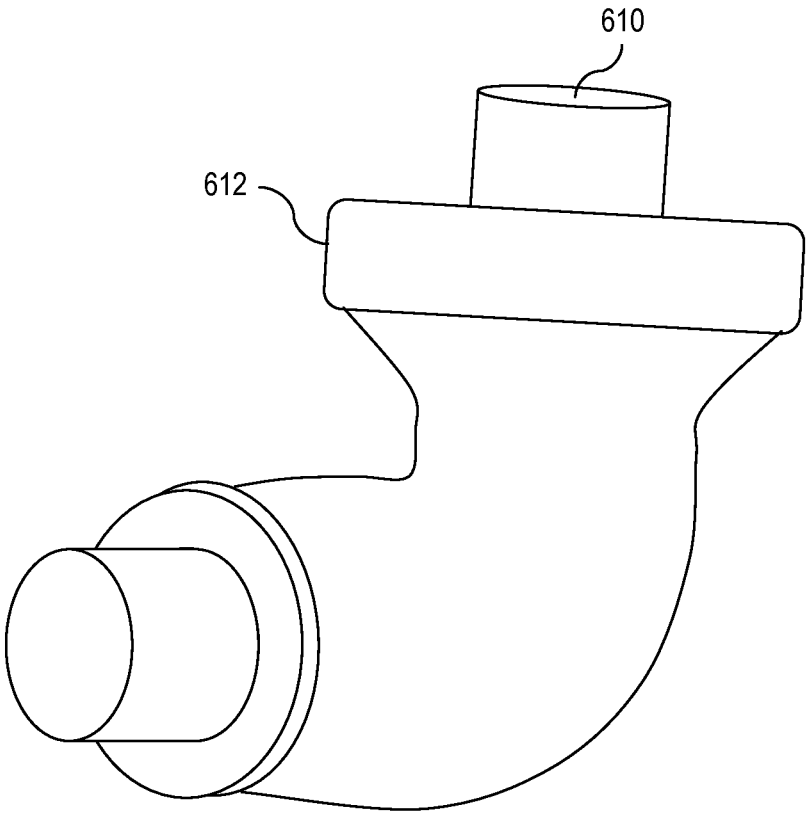
FIG. 7 is an illustration of an exemplary foam pattern structure in the shape of an elbow formed using the mold of FIG. 6, illustrating the temporary core embedded therein.

Referring to FIG. 7, after patterning, a foam pattern structure 612 in the shape of the elbow is provided, having the core 610 extending through the elbow.

After the foam pattern is formed, the temporary core 610 is removed from the pattern independent of caustic chemical leaching, e.g., using a low melting point wax, water soluble or citric acid soluble solution, etc., as defined more fully herein.

Figure 8:
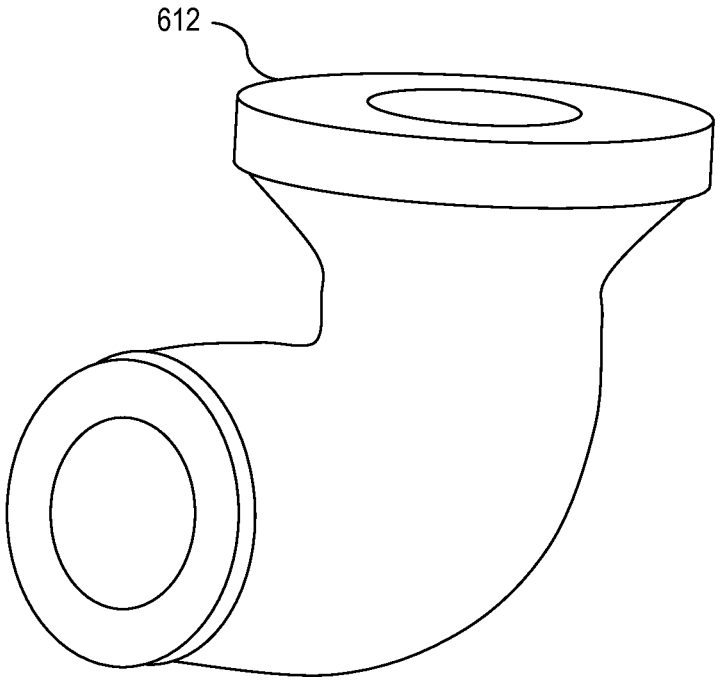
FIG. 8 is an illustration of the exemplary foam pattern of FIG. 9 after the temporary core is removed, using a non-chemical leaching process, according to aspects of the present invention.

Referring to FIG. 8, after removing the core 610 from the foam pattern 612 independent of chemical leaching, an elbow is realized having a passageway there through.

The method 400 (FIG. 4) allows for a feature, such as a channel, void, slot, opening, passageway, etc., a thin-walled feature, to be present in a foam pattern, without using chemical leaching. Thus, various aspects of the present invention allow for the creation of a foam pattern with a feature without the use of caustic chemicals. Further, the method 400 may be used with the method (100, FIG. 1) above to create a channel in a desired foam pattern in portions.

Embedded Structures In Foam Patterns

Figure 9:
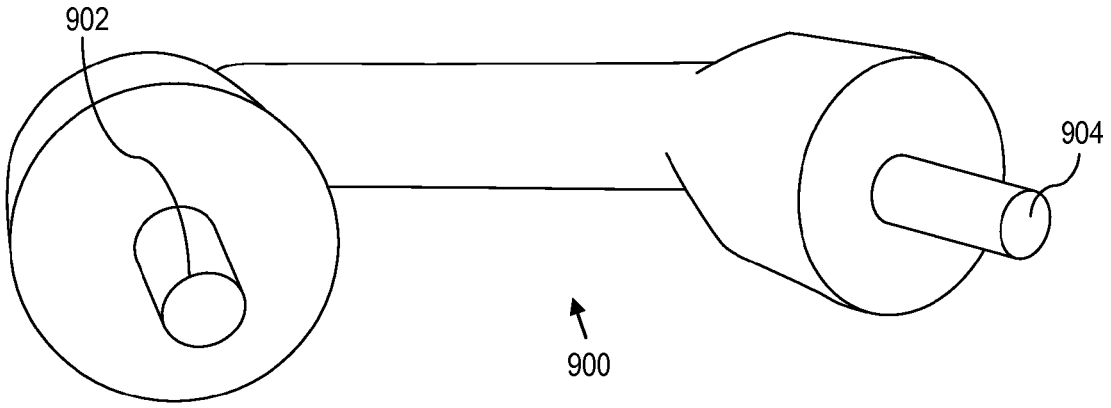
FIG. 9 is a view illustrating use of a metal core to create a foam pattern according to various aspects of the present invention.
Figure 10:
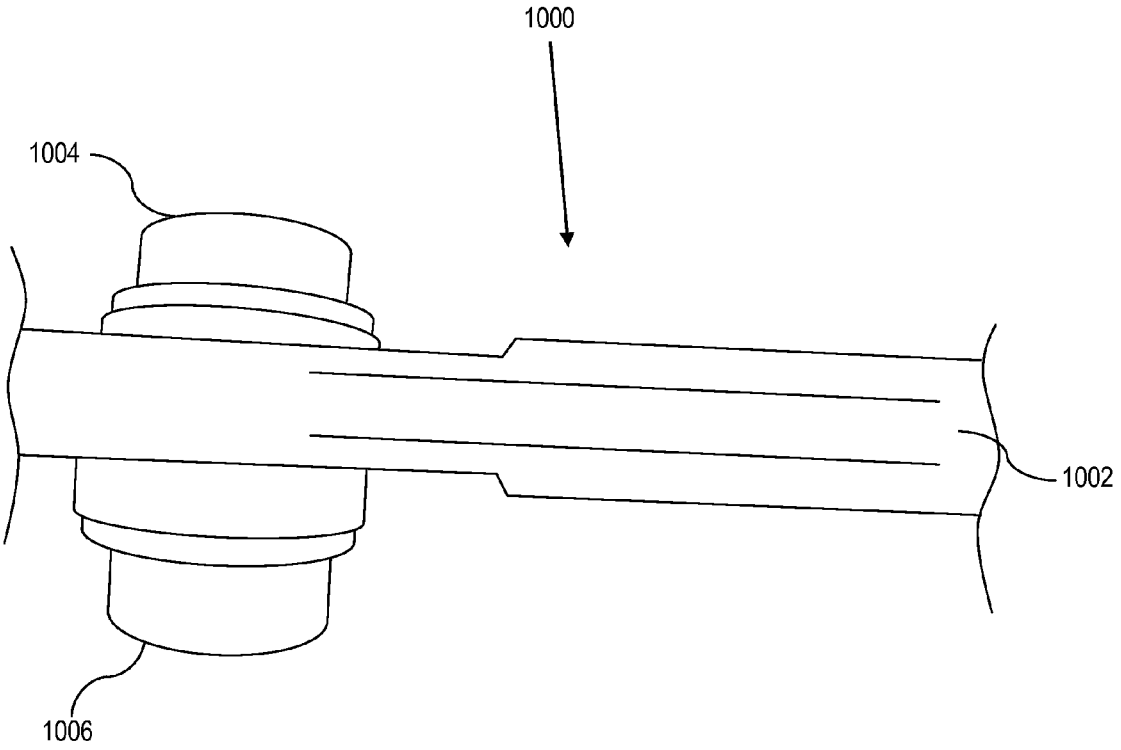
FIG. 10 is a view illustrating creating a foam pattern around a ceramic core according to various aspects of the present invention.

Referring now to FIGS. 9 and 10, a material may be embedded into the foam pattern. The following examples are for illustration only and should not be considered limiting. The general concepts of implementing a core in a foam pattern applies to many different desired patterns.

FIG. 9 illustrates a foam pattern 900 with two metal core ends 902, 904 projecting from the foam pattern 900. In this case, the metal cores 902, 904 are not removed from the pattern 900. The metal cores could be stainless steel tubing that is sometimes used in wax patterns to allow for casting aluminum around the tubes, so the final product is an aluminum casting with stainless steel tubes inside for example to allow flow of hydraulic fluids.

FIG. 10, is a schematic that illustrates creating a foam pattern 1000 around a ceramic core 1002 according to various aspects of the present invention. The user inserts the mixture around a ceramic core 1002 and allows the pattern to cure in a manner analogous to that described in greater detail herein. In an illustrative example, hexagonal, hockey puck sized ceramic plates are built into foam patterns. As shown, elements 1004 and 1006 are extensions or core prints of the same ceramic core 1002. However, elements 1004 and 1006 are covered in a small/thin coat of wax for easier processing. Notably, in this application, wax as commonly used in lost wax processing, is not strong enough to support the overall size of the structure. However, the foam pattern exhibits sufficient strength and rigidity to support the ceramic plates.

As an illustrative example, a ceramic plate or core can be used that stays in place after being encapsulated in metal for applications such as military armor applications. By using the foam material described more fully herein, one can make arrays that are larger and heavier that could be supported by the use of wax.

In an illustrative example, the ratio of ceramic to foam is 10:1. This ratio is based upon the property of the foam and can be changed depending upon the application. For instance, the cross-sectional thickness of a part to be produced can affect the ratio.

Expendable Foam Support Structures:

According to still further aspects, it may be necessary at times to support a core 1110 within a cavity of a mold 1100, e.g., while the mixture is being inserted into the mold, while waiting for the mixture reaction to form a foam pattern structure, etc. Accordingly, in certain illustrative implementations, expendable foam support structures are used to support the core (temporary or otherwise) within the mold during patterning operations. The foam support structures are termed "expendable" because the foam support structures will integrate/assimilate into the foam pattern itself.

As an illustrative example, a method of creating a foam pattern comprises mixing a polyol component and an isocyanate component to form a liquid mixture as described more fully herein. The method further comprises using the mixture to form at least one expendable foam support structure, e.g., a pin, holder or other necessary structure to support the temporary core. The expendable foam support structure can be made using a suitable mold and other techniques as set out more fully herein. Moreover, the expendable foam support structures can be constructed from the same mixture used to form the desired foam pattern structure. Alternatively, foam pattern structures, e.g., in the shape of pins, holders, etc., can be prepared in advance using the same mixture, or a different mixture of a polyol component and isocyanate component, as described more fully herein.

Figure 11:
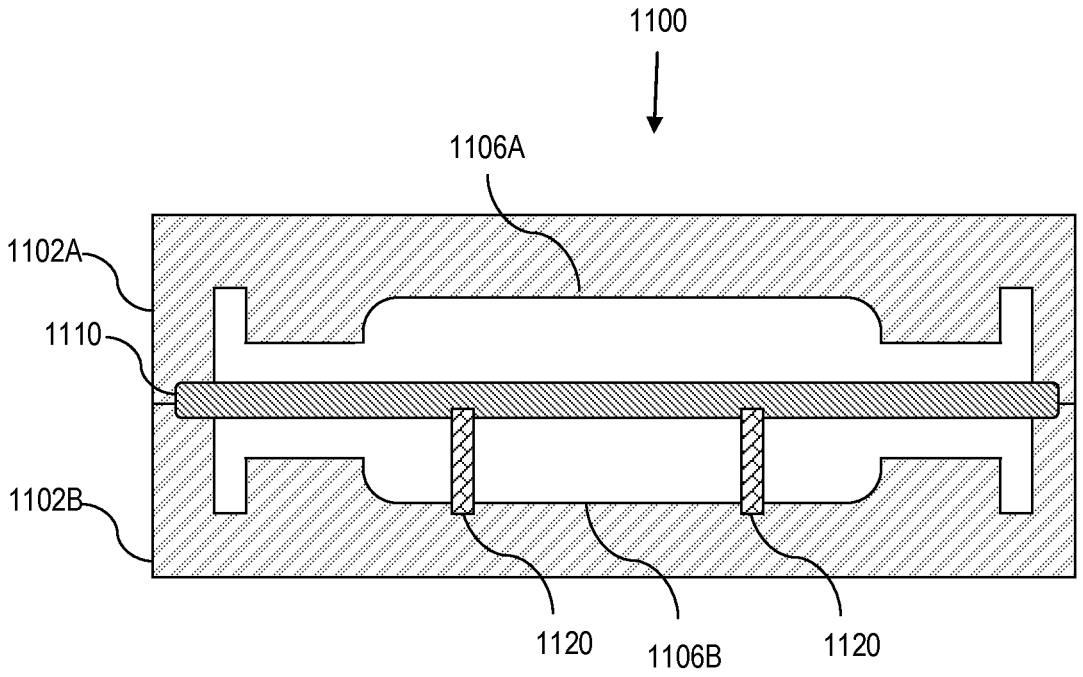
FIG. 11 is a schematic view illustrating the use of expendable foam support structures to suspend a core in a cavity of a mold according to aspects of the present invention.

The method further comprises placing at least one expendable foam support structure in the cavity of the mold. Referring to FIG. 11, the mold 1100 is comprised of mating clamshell mold halves 1102A and 1102B. When the mold halves are joined, they form a cavity comprised of a first cavity half 1106A and a second cavity half 1106B. The core 1110 is placed in the mold 1100 at least partially suspended from the cavity walls such that at least a portion of the core 1110 extends into the cavity. Expendable foam support structures 1120, e.g., foam pins, are each inserted optionally into a corresponding aligning depression in the mold. The aligning depression(s) aid in proper alignment of the support pins but are not required. The method still further comprises placing the core 1110 in the cavity of the mold so as to be at least partially suspended from the cavity walls by at least one expendable foam support structure 1120 placed in the cavity.

Also as illustrated in FIG. 11, the expendable foam support structures 1120 suspend the core 1110 away from the walls of the cavity 1106A, 1106B within the mold 1100, in this illustrative example.

The method further comprises inserting the mixture into the cavity of the mold so that the mixture flows into the cavity and surrounds at least a portion of the core 1100 and surrounds around at least a portion of each inserted expendable foam support structure 1120. In this regard, the support structures can be left in place within the mold cavity, and will become an integral part of the foam pattern structure when the foam pattern structure is formed.

Also, the method comprises waiting for a predetermined time sufficient for a reaction from the mixture to form a foam pattern structure within the mold corresponding to the shape of the cavity of the mold, wherein the foam pattern structure encloses at least a portion of the core 1100 and integrates each expendable foam support structure into the foam pattern structure. Once cured, the method comprises removing the foam pattern structure having the core therein, from the mold. If the core is a temporary core, the method further comprises removing the temporary core from the foam pattern structure independent of caustic chemical leaching, as described more fully herein. Alternatively, where the core is to remain in the foam pattern, e.g., a metal rod, ceramic plate, etc., no further processing is required.

Notably, there is no need to remove the expendable foam support structures that are now integrated into the foam pattern. Because the expendable foam support structures are themselves foam, they will burn out during subsequent processing in a manner analogous to the remainder of the resulting foam structure.

In this application, the foam pattern pins 1120 eliminate the need for metal or other non-foam pins used to support the core 1110 during pattern formation. The foam pattern pins 1110 further eliminate the necessity of negatives, etc., because the mixture will integrate with the foam pattern pins.

In illustrative exemplary implementations, the foam pattern structure comprises an aggregate pattern density of not more than 8 pounds per cubic foot after the temporary core is removed from the foam pattern structure. In yet further alternative embodiments, the foam pattern structure can exceed 8 pounds per cubic foot in aggregate pattern density, e.g., where a particular application requires relatively greater aggregate density.

Foam Pattern as a Wax Chill:

According to still further aspects of the present invention, a foam pattern structure, as described more fully herein, is used as a wax chill where wax is encapsulated around at least a portion of a pattern. As such, only a single mold is required to accommodate two or more similar patterns.

Wax chill, also referred to as pre-form, is used to reduce the dimensional shrinkage variation of wax sections especially for the thick sections of wax patterns. Moreover, the use of wax chill can be used to reduce cycle time. Using a wax chill process, an approximate shape of pattern is made as a chill. This wax chill shape can be injected in the same material/mold used to form the foam pattern. Alternatively, the wax chill can be injected in a separate wax tool or an additional cavity formed in a main wax pattern tool. During the wax pattern injection, the wax chill is inserted in the pattern cavity leaving normally approximately a 0.060-0.120 inch (1.5-3.0) millimeters wax wall around the wax chill. In this regard, wax chill can be used with non-filled waxes as well as filled waxes.

The flowchart and block diagrams in the Figures illustrate the architecture, functionality, and operation of possible implementations according to various embodiments of the present invention. In this regard, each block in the flowchart or block diagrams may represent a module, segment, or portion of operation. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. Aspects of the invention were chosen and described in order to best explain the principles of the invention and the practical application, and to enable others of ordinary skill in the art to understand the invention for various embodiments with various modifications as are suited to the particular use contemplated.

What is claimed is:

1. A method of assembling a fugitive foam pattern, the method comprising:

forming in a series of sequential operations, a single foam pattern by:

inserting a mixture comprising polyol and isocyanate into a mold cavity of a first mold corresponding to a first portion of the foam pattern;

waiting for a predetermined time sufficient for a first reaction from the mixture to form the first portion of the foam pattern, wherein the first portion includes a first mating surface;

exposing the first mating surface of the first portion of the foam pattern to a mold cavity of a second mold corresponding to a second portion of the foam pattern by:

removing the first portion of the foam pattern from the first mold after the first portion of the foam pattern is formed;

placing the foam pattern structure corresponding to the first portion in a guide; and placing the second mold in the guide such that the cavity of the second mold mates with the mating surface of the first portion;

inserting the mixture into the mold cavity of the second mold corresponding to the second portion of the foam pattern;

waiting for a predetermined time sufficient for a second reaction from the mixture to form the second portion of the foam pattern such that the second reaction integrally adheres the second portion to the first mating surface of the first portion that was previously formed, wherein the second portion of the foam pattern includes a second mating surface;

exposing the second mating surface of the second portion of the foam pattern to a mold cavity of a third mold corresponding to a third portion of the foam pattern by:

removing the second portion of the foam pattern from the second mold after the second portion of the foam pattern is formed; and placing the third mold in the guide such that the cavity of the third mold mates with the second mating surface of the second portion;

inserting the mixture into the mold cavity of the third mold corresponding to the third portion of the foam pattern;

waiting for a predetermined time sufficient for a third reaction from the mixture to form the third portion of the foam pattern such that the third reaction integrally adheres the third portion to the second mating surface of the second portion; and removing the third portion of the foam pattern from the third mold, wherein the third portion extends the first portion and second portion to define the overall single foam pattern for use in making a shell mold of a component to be made in a subsequent casting operation;

wherein:

the first portion, the second portion, and third portion are repeating similar sections assembled serially by forming one instance at a time in the guide; and the guide includes at least one channel to hold the foam pattern portions during assembly.

2. The method of claim 1, wherein exposing the first mating surface of the first portion of the foam pattern to a mold cavity of a second mold corresponding to a second portion of the foam pattern comprises inserting the first mating surface of the first portion into an open end of the second mold, where the open end of the second mold exposes the cavity of the second mold, and inserting the first mating surface of the first portion closes off the open end.

3. The method of claim 1, wherein:

waiting for a predetermined time sufficient for a first reaction from the mixture to form the first portion of the foam pattern comprises waiting a sufficient time for the first reaction from the mixture to form a first thermoset rigid foam pattern structure;

waiting for a predetermined time sufficient for a second reaction from the mixture to form the second portion of the foam pattern comprises waiting a sufficient time for the second reaction from the mixture to form a second thermoset rigid foam pattern structure; and the second reaction integrally adheres the second thermoset rigid foam pattern structure to the first thermoset rigid foam pattern structure to form a unitary structure having a continuous surface free from surface-connected open pores that prevents a slurry from penetrating the foam pattern surface when forming a shell mold using the foam pattern such that the formulation and density of the foam pattern does not crack the shell mold during the removal of the foam pattern structure through a burn out process; wherein:

no other bonding material is required to form the overall pattern other than the integral adhering of the mixture to itself.

4. The method of claim 1, wherein inserting a mixture comprising polyol and isocyanate into a mold cavity of a first mold comprises hand pouring the mixture into the mold.

5. The method of claim 1, wherein waiting for a predetermined time sufficient for a first reaction from the mixture to form the first portion of the foam pattern comprises determining that a reaction from the mixture has formed a foam pattern structure corresponding to the cavity of the first mold.

6. The method of claim 1, wherein exposing the first mating surface of the first portion of the foam pattern to a mold cavity of a second mold comprises removing a portion of the first mold, thus exposing the first mating surface.

7. The method of claim 1, wherein exposing the first mating surface of the first portion of the foam pattern to a mold cavity of a second mold corresponding to a second portion of the foam pattern comprises aligning the first mating surface of the first portion with the cavity of the second mold such that the first mating surface of the first portion acts as an interior surface of the second mold.

8. The method of claim 7 further comprising aligning the first mating surface of the first portion with the cavity of the second mold before inserting the mixture into the second mold.

9. The method of claim 7 further comprising:

providing the second mold having an open face; and aligning the second mold with the first mating surface of the first portion after the mixture is inserted into the second mold.

10. The method of claim 1, wherein:

waiting for a predetermined time sufficient for a second reaction such that the second reaction integrally adheres the second portion to the first mating surface of the first portion of the foam pattern comprises integrally adhering the second portion to the first mating surface of the first portion, thus extending a unitary, overall foam pattern.

11. The method of claim 1, further comprising reusing the first mold as the second mold so as to create the first portion of the foam pattern identical to the second portion of the foam pattern.

12. The method of claim 1, further comprising using different shapes to the first mold and the second mold so as to create different structures that form a part of an overall foam pattern.

13. The method of claim 1, wherein the second reaction integrally adheres the second portion to the first mating surface of the first portion of the foam pattern without using other bonding material.

14. The method of claim 1, wherein exposing the second mating surface of the second portion to a mold cavity of a third mold corresponding to a third portion of the foam pattern comprises reusing a select one of the first mold or the second mold as the third mold.

15. The method of claim 1 further comprising:

sequentially building the foam pattern for a plurality of portions by:

exposing a mating surface of a previous portion to a mold cavity of a next mold corresponding to a next portion of the foam pattern;

inserting the mixture into the mold cavity corresponding to the next portion of the foam pattern; and waiting for a predetermined time sufficient for a reaction from the mixture to form the next portion of the foam pattern such that the reaction integrally adheres the next portion to the previous mating surface of the previous portion.

* * * * *